United States Patent [19]

Stanford

[11] Patent Number: 5,007,134

[45] Date of Patent: Apr. 16, 1991

[54] REMOVABLE HINGE AT SPECIFIC ANGULAR ORIENTATION

[76] Inventor: Ferdinand G. Stanford, 826 Covey Hill Road, Hemmingford, Quebec, Canada, H0L 1H0

[21] Appl. No.: 902,661

[22] Filed: Sep. 2, 1986

[30] Foreign Application Priority Data

Feb. 19, 1986 [CA] Canada ..... 502191

[51] Int. Cl.[5] ..... E05D 7/10

[52] U.S. Cl. ..... 16/266; 16/380

[58] Field of Search ..... 16/262, 265, 266, 380, 16/381, 388

[56] References Cited

U.S. PATENT DOCUMENTS 112,867 7/1908 Herr .
132,053 10/1872 Child ..... 16/266
230,491 7/1880 Peer ..... 16/266
2,677,147 5/1954 Phillips ..... 16/266

FOREIGN PATENT DOCUMENTS 2628951 1/1978 Fed. Rep. of Germany ..... 16/266
964465 8/1950 France .

*Primary Examiner*—Fred Silverberg

[57] ABSTRACT

In bathroom doors which open inwards, it is impossible to remove the door if an obstruction such as a person disabled or laying against the door prevents the door from opening. This invention will permit the door to be removed instantly without destroying the door or the frame and causing possible injuries. This can be done with the door knob locked or unlocked from the outside of the bathroom.

1 Claim, 1 Drawing Sheet

FIG. 2
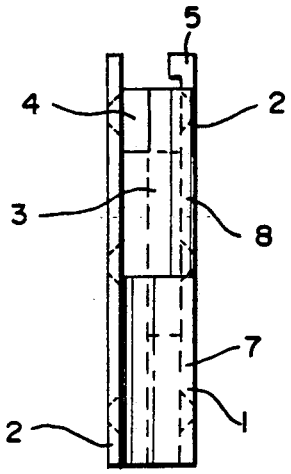
FIG. 1
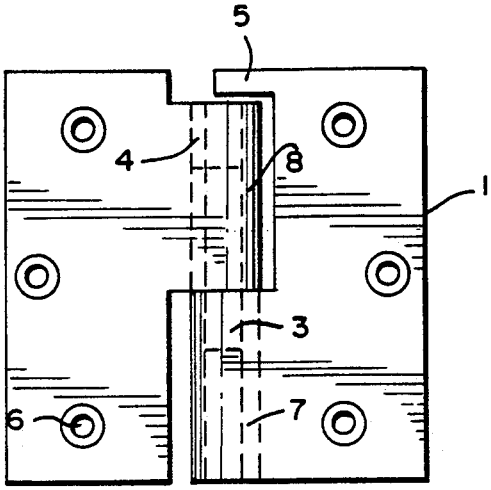
FIG. 3
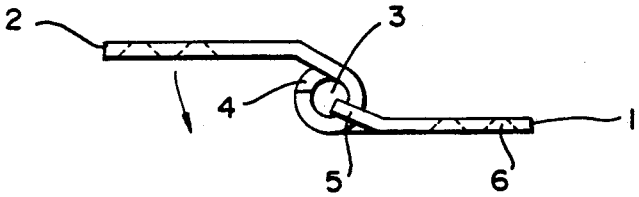
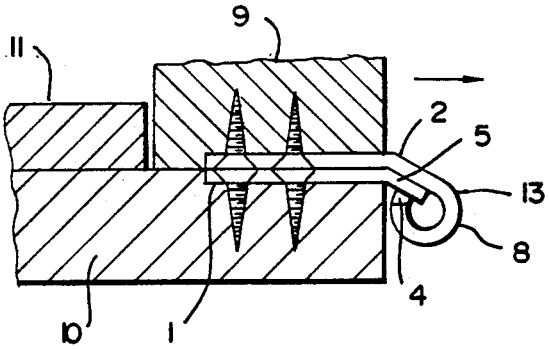
FIG. 4
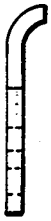
FIG. 6
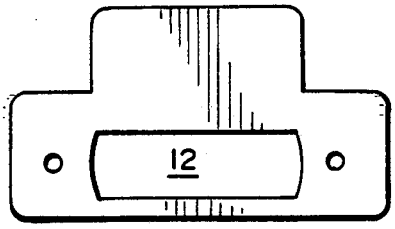
FIG. 5

REMOVABLE HINGE AT SPECIFIC ANGULAR ORIENTATION

BACKGROUND OF INVENTION

1. Field of the Invention

The present invention relates to hinges applicable to doors such as bathroom, bedroom, etc.

2. Description of Prior Art

With the conventional door hinge, it is impossible to remove an inward opening door from the outside of the room with door knob in the locked position without destroying the door. For example, in an emergency situation a person inside a bathroom may faint or become disabled against the door. A person trying to open the door from the outside of the room would push against the victim. In this case, it would cause possible injuries and valuable time may be lost in trying to unlock and remove the door by force.

SUMMARY OF INVENTION

I have found that these disadvantages may be overcome by installing this invention—an auxiliary knob and slotted lock strike plate. This invention provides a rapid lifesaving method by simply removing the door. This invention functions as a dual purpose hinge.

1. For normal opening and closing of doors.
2. For fast and easy removal of a door in an emergency situation.

The hinge features a safety device which prevents the door from being removed in an open position. This will prevent the door from accidentally becoming unhinged.

BRIEF DESCRIPTION OF DRAWINGS

In drawings which illustrate embodiments of the invention:

FIG. 1 shows two cooperating hinge blades side by side.

FIG. 2 is the side view of the hinge assembly in the open position.

FIG. 3 is the top view of the hinge assembly in the open position.

FIG. 4 is the closed view of FIG. 3 installed. Blade 2 is rotated to close against hinge blade 1.

FIG. 5 illustrates a lock strike plate which is an integral part of the door assembly. This elongated lock strike plate will allow the door to be lifted the required amount for removal when the door is locked.

FIG. 6 is a side view of FIG. 5.

DESCRIPTION OF PREFERRED EMBODIMENTS

In the embodiment shown in FIGS. 1 to 4, the hinge consists of two different hinge blades 1 and 2. Left hinge blade 2 is provided partly with a hinge pin 3 which is fixed in the upper sleeve 8. Hinge pin 3 projects down a suitable distance into the lower sleeve 7 on right hinge blade 1. Hinge pin 3 pivots in sleeve 7 on hinge blade 1. Right hinge blade 1 is provided with a tongue 5 which will prevent left hinge blade 2 from separating unless it is in the closed position, FIG. 4. In this closed position tongue 5 will align with slot 4, allowing left hinge blade 2 to raise a distance equal to hinge pin 3 downward projection. Hinge blade 2 can then be slid in an inward direction of arrow A in FIG. 4 to unhinge for removal.

In all other positions, except closed, as in FIG. 4 the tongue 5 will prevent the cooperating blades from becoming disengaged. The tongue 5 will not be in position to slide into slot 4. Sleeves 7 and 8 are offset 13 toward door frame 10. This will provide sufficient clearance for left hinge blade 2, (door 9) to clear right hinge blade 1 (door frame 10). Door stop moulding is 11.

A door fitted with these hinges, a special lock strike plate as shown in FIGS. 5 and 6 would allow the door when locked to be raised. The height is the same as the length of hinge pin 3 projecting below sleeve 8. This distance must also be left between top of door and frame. An auxiliary knob must also be mounted on the same level as the door lock knob, but on the hinged and outward side of the door.

A door can now be removed from the outside of the room in an emergency by grasping both knobs, lifting and pushing slightly on the door. The door will unhinge allowing entry to the room even though somebody may be laying disabled against the door.

Doors in existing construction may easily be retrofitted by installing these hinges with proper clearance at the top of the door. An auxiliary knob and elongated lock strike plate (FIG. 5) would also have to be installed.

The present invention has been illustrated and described by way of an example, but is not confined to the example thus described and illustrated. Various modifications can clearly be made thereto without departing from the ambit of the spirit according to the present invention disclosed in the appended claims.

I claim:

1. A dual purpose hinge for an inwardly opening door comprising in combination:

a first hinge blade with a first sleeve;

a second hinge blade with a second sleeve aligned with said first sleeve;

a hinge pin fixed in said second sleeve of said second hinge blade and projecting therebelow into said first sleeve;

said first hinge blade including a projecting tongue at the top edge of said first hinge blade;

said second hinge blade including a slot at the top edge of said second sleeve arranged to permit said tongue on said first hinge blade to slide into said slot on said second sleeve allowing said second hinge blade to be disconnected from said first hinge blade only when said hinge blades are abutting.

* * * * *